US011994031B2

(12) United States Patent
Spain

(10) Patent No.: US 11,994,031 B2
(45) Date of Patent: May 28, 2024

(54) ROTOR UNIT ASSEMBLY

(71) Applicant: BAE SYSTEMS plc, London (GB)

(72) Inventor: James William Spain, Barrow (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/252,097

(22) PCT Filed: Nov. 3, 2021

(86) PCT No.: PCT/GB2021/052842

§ 371 (c)(1),
(2) Date: May 8, 2023

(87) PCT Pub. No.: WO2022/096868

PCT Pub. Date: May 12, 2022

(65) Prior Publication Data

US 2024/0003255 A1 Jan. 4, 2024

(30) Foreign Application Priority Data

Nov. 9, 2020 (GB) ..... 2017629

(51) Int. Cl.
*F03C 2/00* (2006.01)
*F01C 1/12* (2006.01)
(Continued)

(52) U.S. Cl.
CPC ..... *F01C 1/123* (2013.01); *F01C 21/18* (2013.01); *F04C 18/165* (2013.01); *F04C 18/123* (2013.01); *F04C 29/12* (2013.01)

(58) Field of Classification Search
CPC ..... F04C 18/123; F04C 18/16; F04C 18/165; F04C 18/20; F04C 29/12; F01C 1/123;
(Continued)

(56) References Cited

U.S. PATENT DOCUMENTS 1,766,519 A 6/1930 Johnson
3,852,001 A 12/1974 Miller
(Continued)

FOREIGN PATENT DOCUMENTS

FR 2413549 A1 7/1979
FR 2662468 A1 11/1991
(Continued)

OTHER PUBLICATIONS

International Search Report and Written Opinion received for PCT/GB2021/052842, mailed Feb. 18, 2022. 12 pages.
(Continued)

*Primary Examiner* — Theresa Trieu
(74) *Attorney, Agent, or Firm* — Finch & Maloney PLLC

(57) ABSTRACT

A rotor unit assembly includes a rotor unit having a chamber and a rotor located within the chamber. The rotor has a piston which extends radially outward from the main body of the rotor; and a valve flange with an aperture. The rotor unit further comprises a rotatable hub, with a cavity configured to receive the piston. The rotor unit further comprises a first low pressure port provided in a path described by the piston; a first high pressure port positioned in a path described by the valve flange aperture around the clearance volume; and a second high pressure port positioned in a path described by the cavity around the hub axis.

20 Claims, 14 Drawing Sheets

(51) Int. Cl.

| | |
|---|---|
| ***F01C 21/18*** | (2006.01) |
| ***F03C 4/00*** | (2006.01) |
| ***F04C 2/00*** | (2006.01) |
| ***F04C 18/00*** | (2006.01) |
| ***F04C 18/16*** | (2006.01) |
| *F04C 18/12* | (2006.01) |
| *F04C 29/12* | (2006.01) |

(58) Field of Classification Search
CPC .... F01C 1/16; F01C 1/165; F01C 1/20; F01C 21/08; F01C 21/18
See application file for complete search history.

(56) References Cited

U.S. PATENT DOCUMENTS

| | | | | | |
|---|---|---|---|---|---|
| 3,941,527 | A | | 3/1976 | Allington | |
| 4,023,917 | A | | 5/1977 | Klemm | |
| 4,417,859 | A | * | 11/1983 | Praner | F01C 1/165 418/196 |
| 2005/0268881 | A1 | | 12/2005 | O'Connor | |

FOREIGN PATENT DOCUMENTS

| | | | | | |
|---|---|---|---|---|---|
| FR | 2711740 | A1 | | 5/1995 | |
| GB | 2131487 | A | | 6/1984 | |
| WO | WO-0073627 | A1 | * | 12/2000 | F04C 2/46 |
| WO | 2022096868 | A1 | | 5/2022 | |

OTHER PUBLICATIONS

GB Search Report under Section 17(5) received for GB application No. 2017629.3, dated Mar. 19, 2021. 6 pages.

* cited by examiner

ROTOR UNIT ASSEMBLY

The present disclosure relates to a rotor unit assembly.

In particular the disclosure is concerned with a rotor unit assembly that may comprise part of a compressor system, turbine system in and/or expansion unit.

BACKGROUND

There are numerous known designs of compressors, turbines and fluid expansion devices available. One type has a rotary configuration, with numerous rotors arranged in the same plane and drivingly engaged. One such example is shown in US2005/0268881 A1 (O'Connor) which relates to an internal combustion engine. Such devices are advantageous because they are robust, compact and relatively simple to manufacture. However, the configuration of their fluid passages result in inherent inefficiencies due to fluid flow losses.

Also, such devices have a fixed compression and/or expansion ratio, meaning the performance of the device cannot be adjusted.

Hence an improved device, which has increased efficiency and performance control relative to examples of the related art, is highly desirable.

SUMMARY

According to the present disclosure there is provided a rotor unit assembly as set forth in the appended claims. Other features of the invention will be apparent from the dependent claims, and the description which follows.

Accordingly there may be provided a rotor unit assembly (10) having a rotor unit (90) comprising: a wall section (102) of a housing (100) which defines a chamber (104) having a central axis (106) and an inner surface (108). The housing (100) may comprise an end plate (140) to close the chamber (104). A rotor (200) may be located within the chamber (104) and rotatable about the chamber central axis (106). The rotor (200) may have: a main body (202) having an outer surface (208), the outer surface (208) being spaced apart from the wall section inner surface (108) to define a clearance volume (210). The rotor may comprise a piston (214) which extends radially outward from the main body (202) of the rotor (200).

The rotor may comprise a valve flange (240) which extends radially from the main body (202), with an aperture (242) provided in the valve flange (240).

There may also be provided a rotatable hub (300) rotatable about a hub axis (306), with a cavity (314) which extends radially inward from a hub outer surface (308). The cavity (314) may be configured to receive the piston (214).

The end plate (140) of the housing (100) may define: a first low pressure port (130) provided in the path described the piston (214) around the clearance volume (210); a first high pressure port (120) positioned in the path described the valve flange aperture (242) around the clearance volume (210) such that the first high pressure port (120) is open when the aperture (242) is aligned with the first high pressure port (120), and closed when the aperture (242) is misaligned with the first high pressure port (120), and a second high pressure port (122) positioned in the path described by the cavity (314) around the hub axis (306) such that it is open when the cavity (314) is aligned with the second high pressure port (122), and closed when the cavity (314) is misaligned/offset with the second high pressure port (122).

The wall section (102) may define an opening (150) having a first edge (152) spaced apart from a second edge (154) through which the hub (300) extends to seal against the rotor (200), a seal (310) being provided between the hub outer surface (308) and the edge (152) of the opening.

The first high pressure port (120), first edge (152) of the wall section opening (150), second high pressure port (122), second edge (154) of the wall section opening (150) and first low pressure port (130) may be arranged in series in the direction of rotation of the piston (214) around the clearance volume (210).

When the first high pressure port (120) is open, the piston may form a seal (212) with the inner surface (108) of the chamber (104).

When the second high pressure port (122) is open, the piston (214) may be engaged with the cavity (314) to provide a seal between the piston (214) and the wall of the cavity (314).

The cavity (314) may be configured to be isolated from the clearance volume (210) when the piston (214) has moved D degrees around the inner surface (108) of the chamber (104) away from the second edge (154) of the opening (150) through which the hub (300) extends, to define an expansion region (210-1) of the clearance volume (210) between the piston (214) and the hub (300), the expansion region (210-1) thereby isolated from the remainder of the clearance volume (210). D may have a value of at least 8 but not more than 16.

An opening of the first low pressure port (130) may be positioned C degrees around the inner surface (108) of the chamber (104) away from the second edge (154) of the opening (150) through which the hub (300) extends, where C has a value of at least (D×compression ratio×80%), but no more than (D×compression ratio×120%).

The rotor (200) and hub (300) may be operable to rotate in opposite directions around their respective axes (106, 306), and configured such that as they rotate the first high pressure port (120) is closed before the second high pressure port (122) is opened.

The rotor unit assembly (10) may be operable such that when the first high pressure port (120) is open, the second high pressure port (122) is closed and the first low pressure port (130) is fluidly isolated from the first high pressure port (120). The rotor unit assembly (10) may be operable such that when the second high pressure port (122) is open, the first high pressure port (120) is closed, and first low pressure port (130) is isolated from the second high pressure port (122) by a seal between the piston (214) and the hub (300).

The first high pressure port (120), second high pressure port (122) and first low pressure port (130) may extend through the end plate (140) at one side of the chamber (104) to each provide a fluid conduit therethrough.

The first high pressure port (120) and second high pressure port (122) may each be exhaust conduits from the clearance volume (210), and the first low pressure port (130) may be an inlet conduit to the clearance volume (210).

The ports (120, 122, 130) may be in fluid communication with a manifold (400). The first low pressure port (130) may be in fluid communication with a low pressure chamber (410) of the manifold (400). The first high pressure port (120) and second high pressure port (122) may be in fluid communication with a high pressure chamber (420) of the manifold (400). The low pressure chamber (410) and high pressure chamber (420) may be separated from one another by a wall (440) such that the low pressure chamber (410) and high pressure chamber (420) are fluidly isolated from one another.

The first high pressure port (120) may be provided with a variable valve (500) operable to vary the flow area of the first high pressure port (120).

The variable valve (500) may comprise a control disc (510) centred on and rotatable around the hub axis (306). The control disc (510) may define an aperture (512). The control disc (510) may be operable to moved so that the aperture (512) is in alignment with, partially in alignment with, or offset from, the first high pressure port (120) to thereby vary the flow therethrough.

The rotor (200) may be mounted to the housing (100) via a rotor shaft (250) centred on the chamber central axis (106). The hub (300) may be mounted to the housing (100) via a hub shaft (350) centred on the hub axis (306). The shafts (250, 350) may be parallel to one another.

The rotor unit assembly (10) may comprise a plurality of rotor units (90), each rotor unit (90) spaced apart from one another around the hub axis (306); the rotors (200) each being mounted relative the hub (300) such that, for each rotor unit (200): the hub outer surface (308) is in sealing contact with the outer surface (208) of the respective main body (202) as the respective piston (214) travels around the respective clearance volume (210); and the cavity (314) and respective piston (214) are positioned to engage during part of the rotation of the respective rotor (200) and hub (300) around their respective axes (106, 306).

The port locations and valve scheduling (i.e. opening and closing of ports) of the rotor unit assembly of the present disclosure provide a configuration with improved efficiency relative to examples of rotatory devices the prior art. Additionally, the variable valve arrangement increases the flexibility of performance of the rotor unit assembly of the present disclosure over examples of the related art.

BRIEF DESCRIPTION OF THE DRAWINGS

Examples of the present disclosure will now be described with reference to the accompanying drawings, in which:

FIGS. 17-1 to 17-8 illustrate operation of the rotor unit assembly of the present disclosure;

FIGS. 18-1 to 18-16 illustrate operation of the rotor unit assembly of the present disclosure;

FIGS. 21-1 to 21-5 illustrate operation of the variable valve arrangement shown in FIGS. 19, 20.

DETAILED DESCRIPTION

The present disclosure relates to a rotor unit assembly 10. The rotor unit assembly 10 may be configured to operate as a compressor and/or part of compression system, a turbine and/or part of a turbine system, a fluid expansion apparatus, a fluid displacement apparatus (for example a pump), a heat engine and/or heat pump, part of an internal combustion engine or air conditioning unit.

Figure 1:
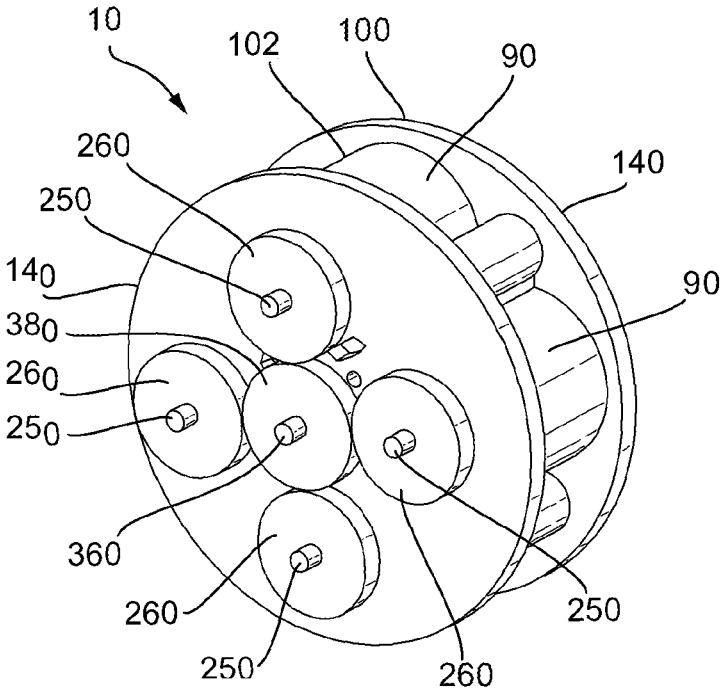
FIG. 1 shows an example of the rotor unit assembly of the present disclosure, with part of its housing removed.
Figure 2:
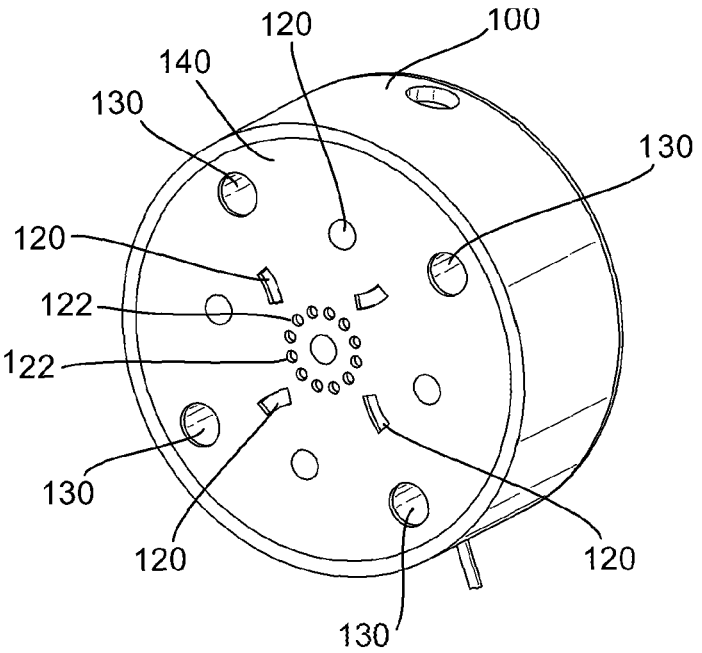
FIG. 2 shows a different view of the rotor unit assembly shown in FIG. 1, with a different combination of features shown.
Figure 3:
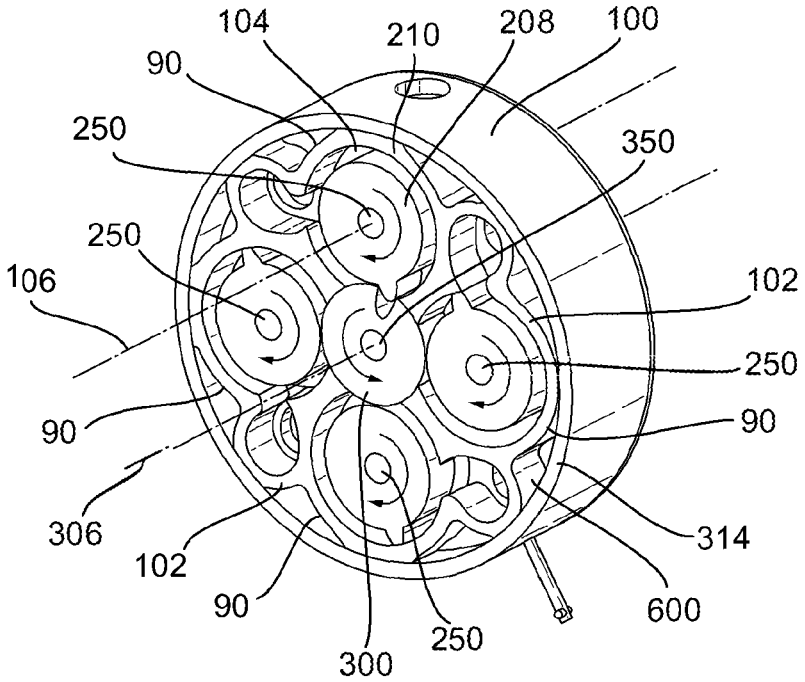
FIG. 3 shows the same view as FIG. 2, but with a front part of a casing removed.

FIGS. 1 to 3 show the rotor unit assembly 10 of the present disclosure with different combinations of components present to thereby illustrate different aspects of its structure. FIGS. 6 to 13 show enlarged views of the arrangement shown in FIG. 3, with the components in various different configurations;

As first shown in FIG. 3, the rotor unit assembly 10 comprises a rotor unit 90. A rotor unit assembly 10 according to the present disclosure may comprise one or more rotor units 90. In the example shown there are provided four rotor units 90 spaced apart from one another in a planetary configuration around a central rotatable hub 300. Each rotor unit 90 may be substantially the same. In the present disclosure where it is described that the rotor unit assembly 10 comprises "a rotor unit 90", this includes examples of rotor unit assemblies having additional rotor units 90 (e.g. in total two or more) in addition to the rotor unit 90 being described.

Figure 6:
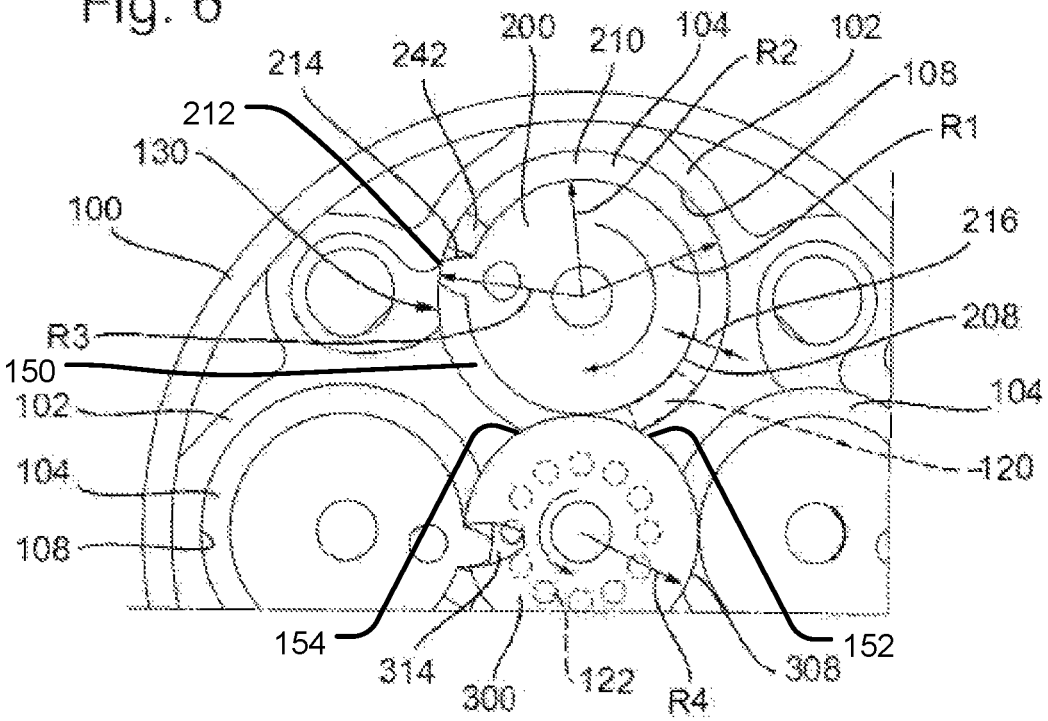
FIGS. 6 to 13 show enlarged views of the arrangement shown in FIG. 3, with the components in various different configurations.
Figure 7:
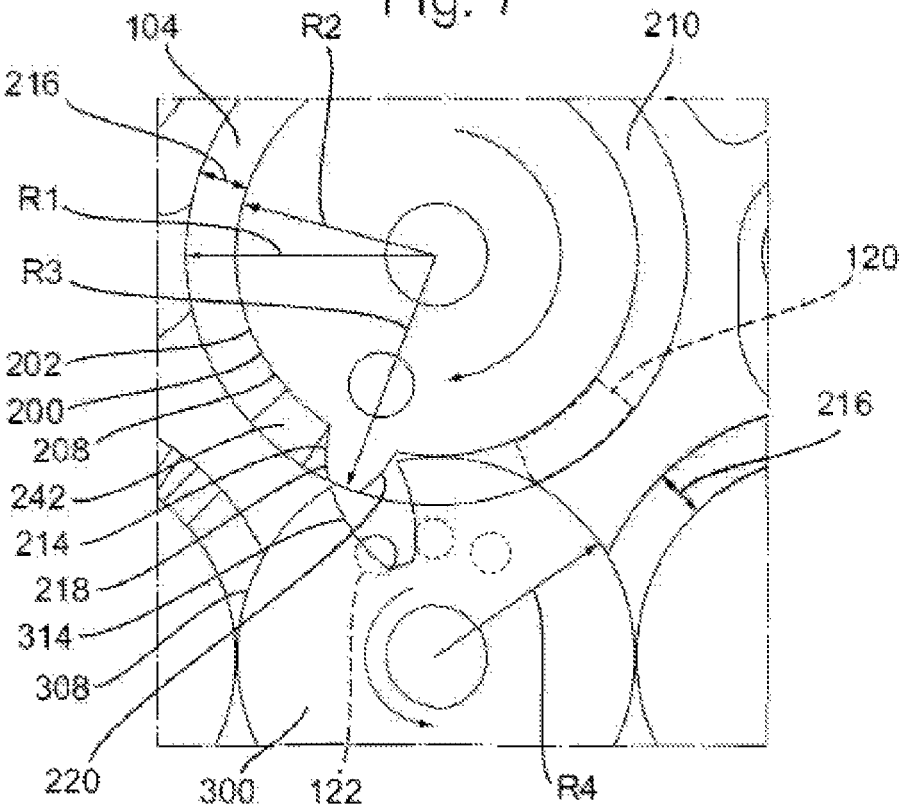
Figure 8:
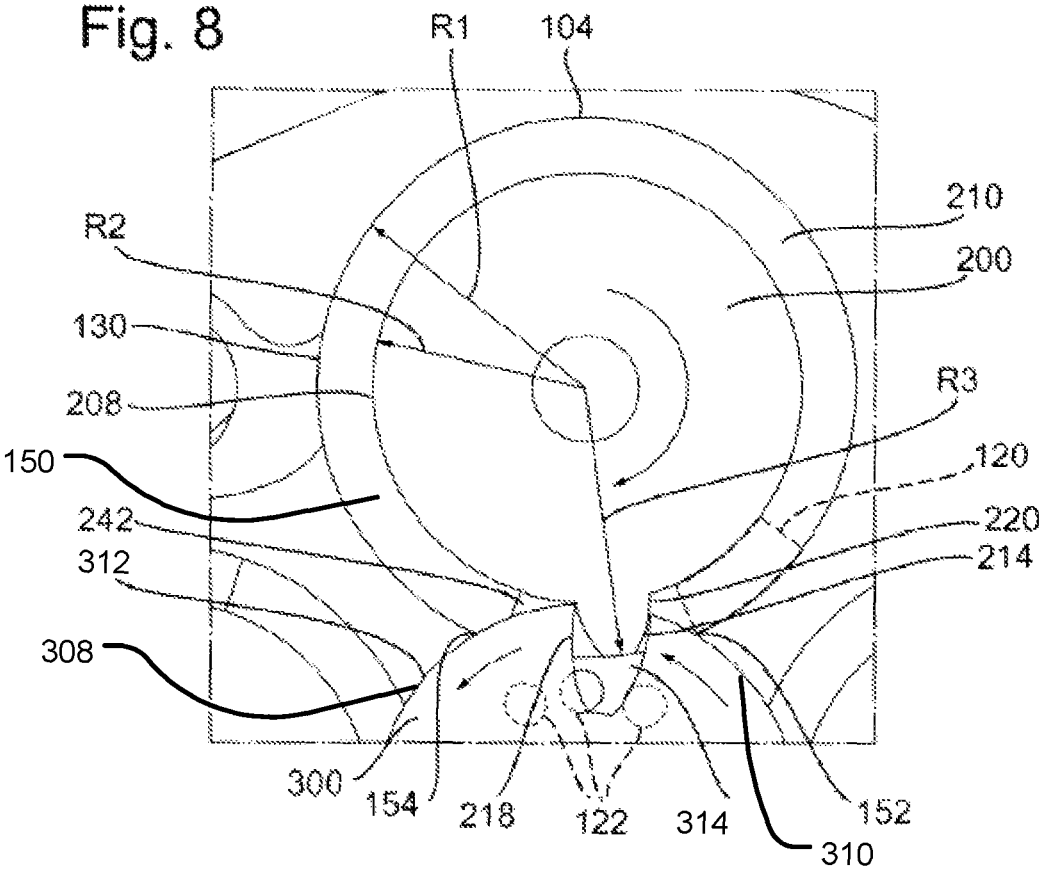
Figure 9:
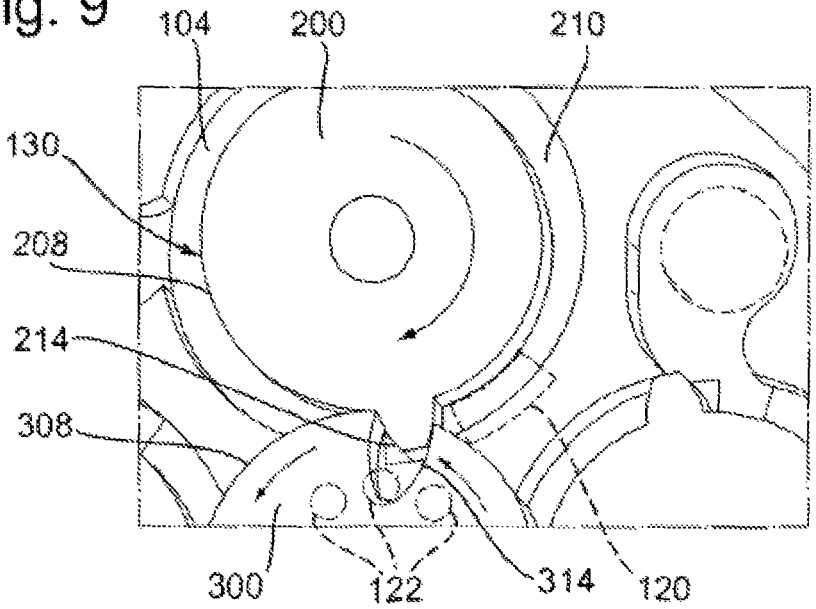

As illustrated in FIGS. 6 to 8, the (or each) rotor unit 90 comprises a wall section 102 of a housing 100 which defines a chamber 104 (for example a cylindrical chamber 104) having a central axis 106 and an inner surface 108 with an internal radius R1. The (or each) rotor unit 90 also includes a rotor 200, which may be cylindrical (i.e. has a circular cross-section along at least part of its height) located within the chamber 104 and rotatable about the chamber central axis 106.

As shown in FIG. 1, the housing 100 may comprise an end plate 140 at either end of the wall section 102 to close the chamber 104.

Figure 4:
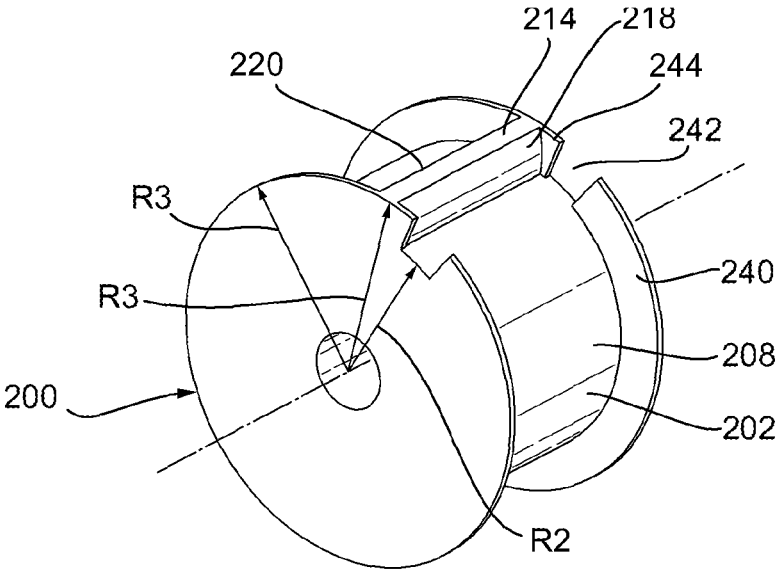
FIG. 4 shows one example of a rotor which forms part of the device of the present disclosure.
Figure 5:
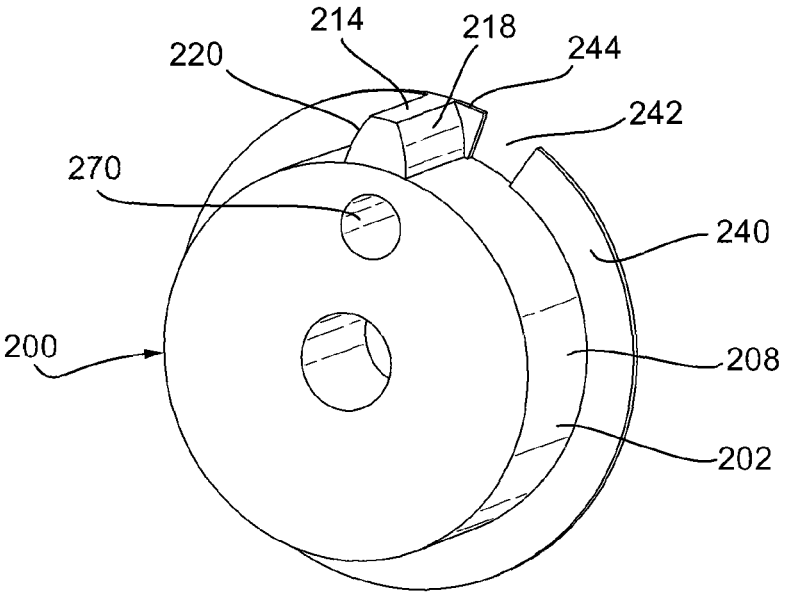
FIG. 5 shows an alternative example of a rotor which forms part of the device of the present disclosure.

An example of a rotor 200 is shown in FIG. 4. A further example of a rotor is shown in FIG. 5. In each example the rotor 200 has a main body 202 having an outer cylindrical surface 208 with an external radius R2. As shown in FIGS. 3, 6 to 13, when installed chamber 104, the outer surface 208 of the rotor is spaced apart by a gap 216 from the wall section inner surface 108 to define a clearance volume 210.

Figures 1, 17:
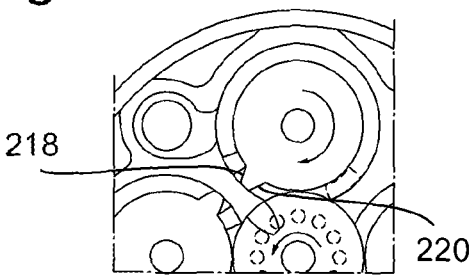
Figures 2, 17:
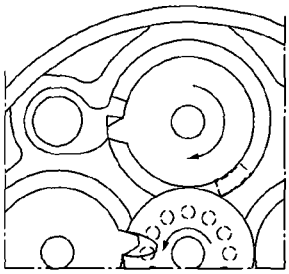
Figures 3, 17:
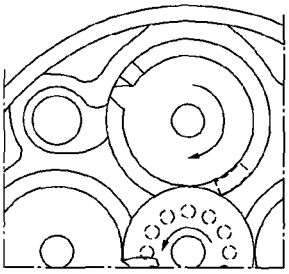
Figures 4, 17:
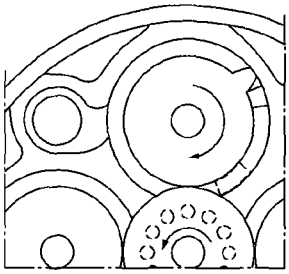
Figures 5, 17:
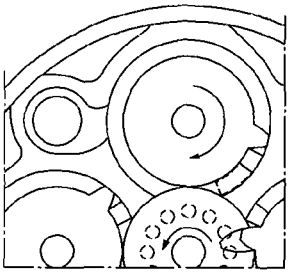
Figures 6, 17:
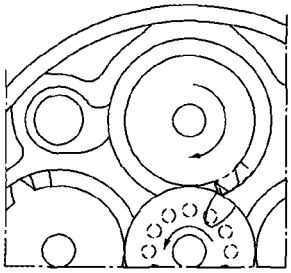
Figures 7, 17:
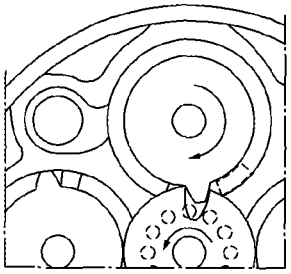
Figures 8, 17:
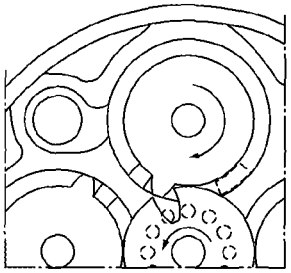

A piston 214 extends radially outward from the main body 202 of the rotor 200 to a radius R3 to form a rotary piston. As can be seen in FIGS. 3, 6 to 13, the piston 214 extends across the gap 216 between the rotor 200 and wall section 102 to form a seal 212 where it meets the inner surface 108 of the chamber 104. The piston 214 has a leading edge 218 and a trailing edge 220. The leading edge 218 is the face which travels ahead of the trailing edge 220 as the rotor 200 travels around the clearance volume 210 (for example as shown in FIGS. 17-1 to 17-8).

Hence the clearance volume 210 extends around the main body 202 of the rotor 200, and is divided by the piston 214 since the piston 214 extends across the clearance volume 210.

As shown in FIGS. 4, 5 the rotor 200 may further comprise a valve flange 240 which radially extends from the main body 202 (for example from the rotor outer surface 208) to have a radius equal to the piston radius R3 around its circumference. In the example of FIG. 4 the rotor 200 is provided with a valve flange 240 on one side of the main body 202. In the example of FIG. 5 the rotor 200 is provided with a valve flange 240 on each (i.e. opposite) sides of the main body 202. The outer surface 208 of the main body 202 is recessed from the outer circumference of the/each end plate 240.

An aperture (e.g. cut out, or slot) 242 is provided in the valve flange 240 to define a flow path therethrough. In examples in which a valve flange 240 is provided on each (i.e. opposite) sides of the main body 202 an aperture 242 is provided in the valve flange 240 that, when the rotor 200 is located in the chamber 104, covers the first high pressure port 120. In the same example, there may also be provided an aperture 242 on the other flange 240. Alternatively the other flange may have constant height around its circumference (i.e. have no aperture 242).

The (or each) valve flange 240 is sealed against the end plate 140 of the housing 100. For example, the valve flange 240 with the valve aperture 242 is sealed against the end plate 140 of the housing 100. Thus the aperture 242 defines a flow path when the aperture 242 is aligned with the high pressure port 120.

The aperture 242 is provided on the leading edge 218 side of piston 214. That is to say, aperture 242 is spaced apart from the trailing edge 220 of the piston 214 by the leading edge 220 of the piston 214. The aperture 242 may extend along the valve flange 240 from the leading edge 218 of the piston 214. A the valve flange 240 may define a baffle 244 which extends from the leading edge 218 to the edge of the valve aperture 242. The baffle 244 may extend up to 30 degrees around the circumference of the rotor body 202. Alternatively, the baffle 244 may extend up to 20 degrees around the circumference of the rotor body 202. In a further example the baffle 244 may extend up to 10 degrees around the circumference of the rotor body 202.

The valve flanges 240 may be removeable from the rotor 200, so that differently configured valve flanges 240, with different sized aperture 242, may be attached. This may be used as a simple method of modifying the compression ratio of the machine, as the compression ratio is dependent on the aperture size 242.

To achieve a dynamically balanced rotor 200, additional holes 270 may be machined in the internal structure of the rotor 200 (as shown in FIG. 5).

The rotatable hub 300 is rotatable about a hub axis 306. The hub 300 has an outer surface 308 having a radius R4. In some examples, the hub radius R4 is the same as the rotor radius R2. In other examples, the hub radius R4 may be larger or smaller than the rotor radius R2. The hub 300 defines a cavity 314 which extends radially inward from the hub outer surface 308. The cavity 314 is configured to receive the piston 214. The hub 300 may be cylindrical (i.e. has a circular cross-section along at least part of its height).

The baffle 244 of the valve flange 240 is provided to avoid flow losses from the high pressure side to the low pressure side of the piston when the piston 214 is meshed with (i.e. received in) the cavity 314.

The wall section 102 of the housing defines an opening 150 having a first edge 152 spaced apart from a second edge 154 through which the hub 300 extends, a seal 312 being provided between the hub outer surface 308 and the edge 154 of the opening.

The rotor 200 and hub 300 may be mounted relative to one another on the housing 100 such that their respective axes 106, 306 are parallel.

The rotor 200 and hub 300 are mounted relative to one another on the housing 100 such that the hub outer surface 308 is in sealing contact with the outer surface 208 of the main body 202 as the piston 214 travels around the clearance volume 210.

The rotor 200 and hub 300 may be mounted relative to one another on the housing 100 such that the cavity 314 and piston 214 are positioned to mesh/engage during part of the rotation of the rotor 200 and hub 300 around their respective axes 106, 306.

As set out above, and as shown in the figures, a rotor unit assembly 10 of the present disclosure may comprise a plurality of rotor units 90. Each rotor unit 90 may be spaced apart from another around the hub axis 306 in a planetary arrangement. The rotors 200 may each be mounted relative the hub 300 on the housing 100 such that, for each rotor unit 90 the hub outer surface 308 is in sealing contact with the outer surface 208 of the respective main body 202 as the respective piston 214 travels around the respective clearance volume 210, and so that the cavity 314 and respective piston 214 are positioned to mesh (i.e. engage) during part of the rotation of the respective rotor 200 and hub 300 around their respective axes 106, 306.

Working fluid leakage through the valve ports and between the rotor hub and housing plates is limited by tightly controlled tolerances being maintained on the machined casing internal diameters, bearing clearances, hub outer diameter, and rotor outer diameters and seal profile. The width of all these components is also accurately controlled to maintain a small clearance (for example 0.5 mm or less), which allows for minimum loss of fluid.

As shown in FIGS. 6, 7 the profile of the piston 214 can be achieved by using a commonly used involute profile, shaped to match the desired interface (i.e. the cavity 314) of the hub 300.

The profile of the interface between the rotor 200 and the hub 300 must be shaped to minimize the leak path between high pressure and low pressure regions. The hub 300 and rotor 200 profiles must be created in a manner which minimizes clearances through the rotation of both parts. This can be created by a circular profile being machined into the hub 300, with a centre point set to the outer diameter of the hub 300. This diameter can be increased to account for the gear clearance back lash (i.e. where the piston 214 meshes with the cavity 314).

As shown in FIGS. 2, 6 to 13, the end plate 140 of the housing 100 defines a first high pressure port 120 positioned in the path described the valve flange aperture 242 around the clearance volume 210 such that the first high pressure port 120 is open when the aperture 242 is aligned with the first high pressure port 120, and closed when the aperture 242 is misaligned/offset with the first high pressure port 120.

The end plate 140 of the housing 100 also defines a second high pressure port 122 positioned in the path described by the cavity 314 around the hub axis 306 such that it is open when the cavity 314 is aligned with the second high pressure port 122, and closed when the cavity 314 is misaligned/offset with the second high pressure port 122.

As shown in the figures, for example FIG. 6, the second high pressure port 122 may comprise a series of apertures in the end plate 140, arranged in a circle centred on the hub axis 306.

The first high pressure port 120 is shown as a single aperture. In other examples, not shown, it may be provided as a series of apertures, in a line or clustered together, or provided as a mesh. Such configurations of the first high pressure port 120 may advantageously enable control of the compression ratio of the machine of the present disclosure.

The end plate 140 of the housing 100 also defines a first low pressure port 130 provided in the path described the piston 214 around the clearance volume 210 such that it is in fluid communication with the clearance volume 210.

The first high pressure port 120, second high pressure port 122 and first low pressure port 130 extend through the end plate 140 at one side of the chamber 104 to each provide a fluid conduit therethrough.

The terms "high pressure" and "low pressure" in relation to ports 120, 122, 130 identify the relative states of the working fluid as it passes through those ports during operation of the rotor unit assembly 10. Hence, in operation, working fluid at the high pressure ports 120, 122 will be at a pressure which is higher than working fluid at the low pressure port 130.

In an example in which the rotor unit assembly 10 is configured as a compressor, the first high pressure port 120 and second high pressure port 122 are each exhaust conduits from the clearance volume 210, and the first low pressure port 130 is an inlet conduit to the clearance volume 210.

In an example in which the rotor unit assembly 10 is configured as a compressor, the first high pressure port 120, second high pressure port 122 and first low pressure port 130 may also/alternatively be termed a first exhaust port 120, a second exhaust port 122 and a first inlet port 130 respectively.

The geometry of the high pressure ports 120, 122 and rotor valve aperture 242 set the pressure ratio of the machine. For example, in a compressor, extending the first high pressure port 120 further away from the hub 130, but closer to the first low pressure port 130 (e.g. providing is at a position around the clearance volume 210 anticlockwise to the position shown in the figures) would allow the working fluid to pass through the first high pressure ports 120 earlier in a compression stroke, reducing the compression ratio.

Figure 10:
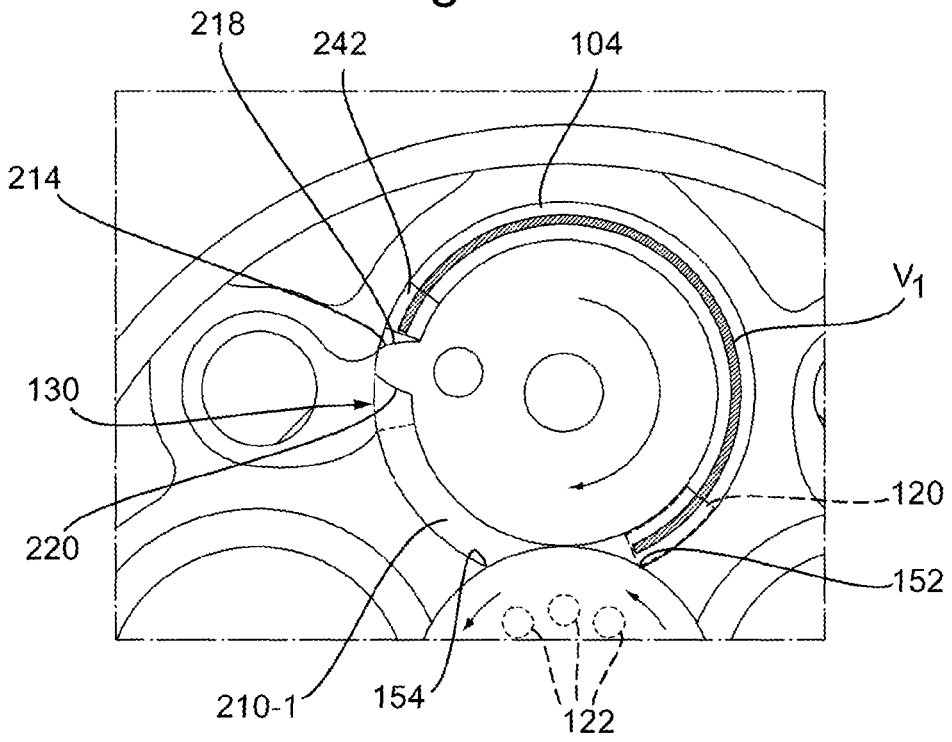
Figure 11:
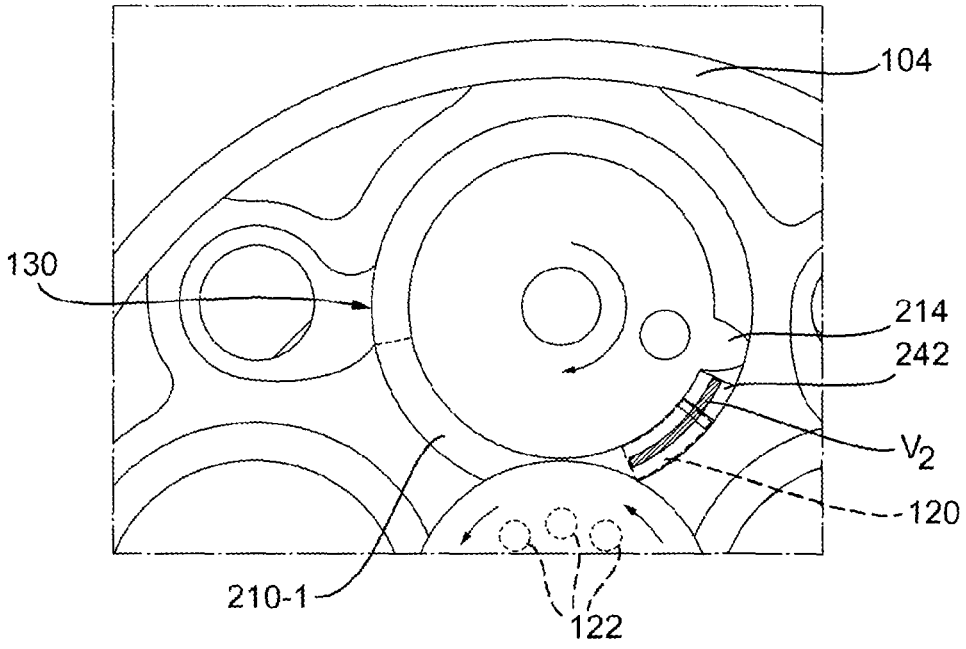

With reference to FIGS. 10, 11, the compression ratio of the unit 90 (i.e. the machine) is the ratio Volume V1:Volume V2.

Volume V1 is the trapped volume of the clearance volume 210 at the instant the low pressure port 130 is closed by the piston 214 (see FIG. 10). Put another way, Volume V1 is the volume of the clearance volume 210 trapped between the leading edge 218 of the piston 214 and the location where the rotor 200 seals against the hub 300 at the instant the low pressure port 130 is closed by the piston 214. In other words, Volume V1 is the portion of the clearance volume 210 defined by the surface the leading edge 218 of the rotary piston 214, outer surface 208 of the rotor 200, outer surface 308 of the hub 300, inner surface 108 of the chamber 104 and end plates 140 at the instant the low pressure port 130 is closed by the piston 214.

Volume V2 is the trapped volume of the clearance volume 210 at the instant just before the first high pressure port 120 is opened by the aperture 242 (see FIG. 11). Put another way, Volume V2 is the volume of the clearance volume 210 trapped between the leading edge 218 of the piston 214 and the location where the rotor 200 seals against the hub 300 at the instant just before the first high pressure port 120 is opened by the aperture 242. In other words, Volume V2 is the portion of the clearance volume 210 defined by the surface the leading edge 218 of the rotary piston 214, outer surface 208 of the rotor 200, outer surface 308 of the hub 300, inner surface 108 of the chamber 104 and end plates 140 at the instant just before the first high pressure port 120 is opened by the aperture 242.

Figure 19:
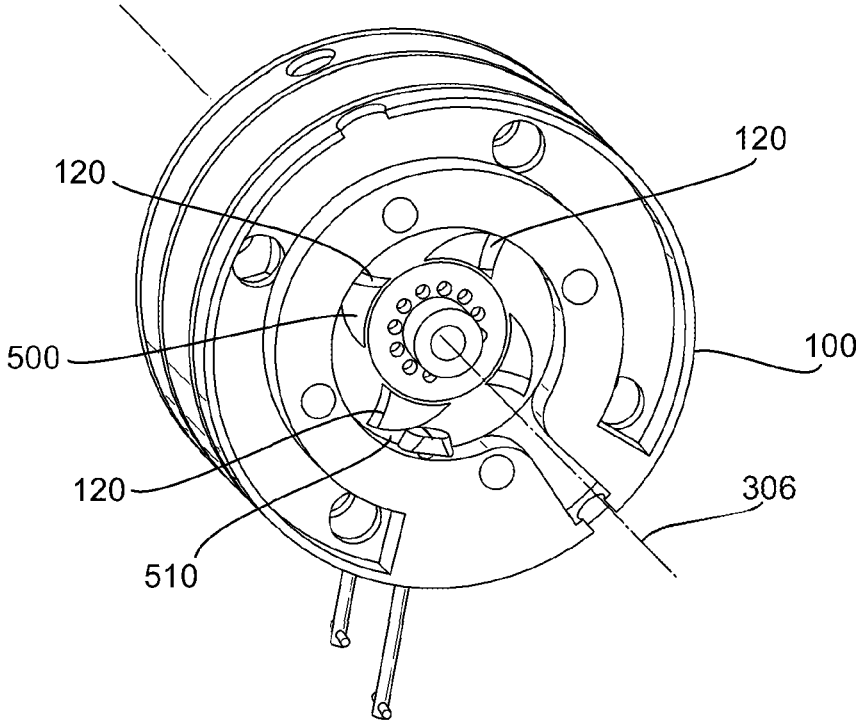
FIGS. 19, 20 show features of a variable valve arrangement of the rotor unit assembly of the present disclosure.

The overall compression ratio can be controlled and/or modified by varying (i.e. altering) the flow area of the first high pressure ports 120, either by enlarging or filling in the first high pressure ports 120, or by using a system as described below in relation to FIGS. 19 to 21 where a variable valve is utilised.

The first high pressure port 120, first edge 152 of the wall section opening 150, second high pressure port 122, second edge 154 of the wall section opening 150 and first low pressure port 130 are arranged in series in the direction of rotation of the piston 214 around the clearance volume 210 (for example as shown in FIGS. 17-1 to 17-8, which illustrates a complete rotation of the rotor 200 and hub 300). Hence, in the direction of rotation (i.e. travel) of the piston 214 (shown as clockwise in FIGS. 17-1 to 17-8) the second high pressure port 122 is located between the first high pressure port 120 and first low pressure port 130. The second high pressure port 122 is located between the first edge 152 and second edge 154 of the wall section opening 150.

The rotor 200 is located (i.e. orientated) in the chamber 104, such that when the first high pressure port 120 is open, the piston 214 forms a seal 212 with the inner surface 108 of the chamber 104.

Additionally, the rotor 200 is located (i.e. orientated) in the chamber 104, such that when the second high pressure port 122 is effectively open, there is a seal between the rotor 200 and the hub 300. The seal between the rotor 200 and the hub 300 may be formed when the piston 214 is engaged/meshed with the cavity 314 to provide a seal between the piston 214 and the wall of the cavity 314.

The rotor 200 and hub 300 are located (i.e. orientated) relative to one another such that the hub cavity 314 is configured to be isolated from the clearance volume 210 when the piston 214 is ([D/360]*100)% of the distance around the inner surface 108 of the chamber 104 away from the second edge 154 of the opening 150 through which the hub 300 extends, to define an expansion region 210-1 of the clearance volume 210 between the piston 214 and the hub 300, the expansion region 210-1 thereby being isolated from the remainder of the clearance volume 210. Hence the expansion region 210-1 is a region (i.e. sub-volume) of the clearance volume 210. In another example, the cavity 314 is configured to be isolated from the clearance volume 210 when the piston 214 has moved D degrees around the inner surface 108 of the chamber 104 away from the second edge 154 of the opening 150 through which the hub 300 extends, to define an expansion region 210-1 of the clearance volume 210 between the piston 214 and the hub 300, the expansion region 210-1 thereby isolated from the remainder of the clearance volume 210. D is dependent on a function of the ratio R3:R4. D may have a value of at least 8 but not more than 16. D may have a value of at least 11 but not more than 14. D may have a value of about 13.

An opening of the first low pressure port 130 is positioned ([C/360]*100)% of the distance around the inner surface 108 of the chamber 104 away from the second edge 154 of the opening 150 through which the hub 300 extends. Put another way, an opening of the first low pressure port 130 is positioned C degrees around the inner surface 108 of the chamber 104 away from the second edge 154 of the opening 150 through which the hub 300 extends. C may have a value of at least 20 but not more than 65. C may have a value of at least 40 but not more than 65. C may have a value of at least 47 but not more than 55. C may have a value of about 52. C may have a value of at least (D×compression ratio×80%), but not more than (D×compression ratio×120%).

The rotor 200 and hub 300 are operable to rotate in opposite directions around their respective axes 106, 306, and configured such that as they rotate, the first high pressure port 120 is closed before the second high pressure port 122 is opened.

The rotor 200 and hub 300 are location (i.e. orientated) relative to one another such that when the first high pressure port 120 is open, the second high pressure port 122 is closed and the first low pressure port 130 is fluidly isolated from the first high pressure port 120 by the seal between piston 214 and the wall section 102 and the seal between rotor outer surface 208 and the hub outer surface 308.

When the second high pressure port 122 is open, the first high pressure port 120 is closed, and the first low pressure port 130 is isolated from the second high pressure port 122 by a seal maintained between the rotor 200 and hub 300, including a seal between the piston 214 and the wall of the hub cavity 314.

Figure 15:
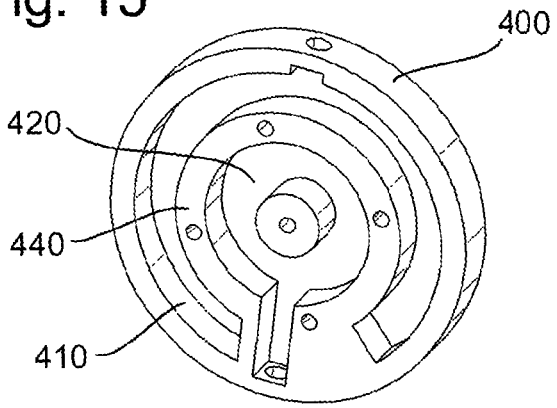
FIGS. 15, 16 show a manifold and part assembly of an example of the rotor unit assembly of the present disclosure.
Figure 16:
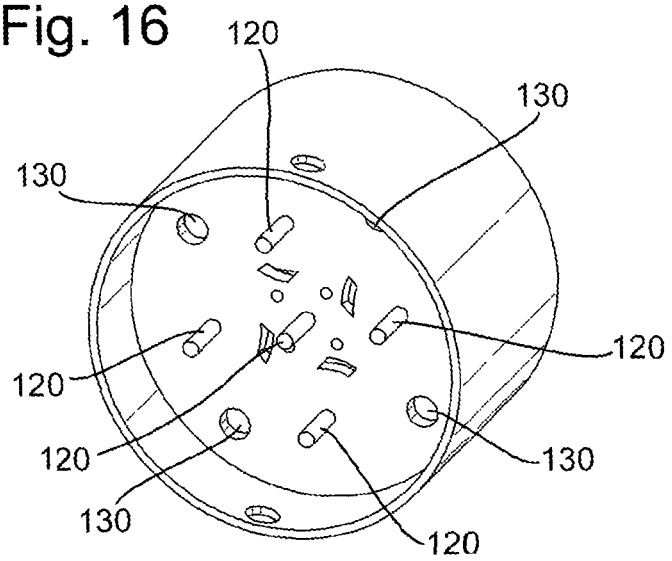

As shown in FIGS. 15, 16 the ports 120, 122, 130 may be in fluid communication with a manifold 400. The manifold 400 defines a low pressure chamber 410 and a high pressure chamber 420. In the example shown the high pressure chamber 420 is provided radially inward of the low pressure chamber 410, and the low pressure chamber 410 extends in a ring around the high pressure chamber 420. The low pressure chamber 410 and high pressure chamber 420 being separated from one another by a wall 440 such that the low pressure chamber 410 and high pressure chamber 420 are fluidly isolated from one another. The first low pressure port 130 is in fluid communication with a low pressure chamber 410 of the manifold 400. The first high pressure port 120 and second high pressure port 122 is in fluid communication with a high pressure chamber 420 of the manifold 400.

Hence the supply and return lines to the high pressure (exhaust) ports 120, 122 and low pressure (inlet) ports 130 can be by means of the manifold 400 shown below. The manifold 400 may be bolted to the inner casing plates 140 with a sealing arrangement to the face of the machine (i.e. rotor unit assembly 10).

As shown in FIGS. 19, 20, 21-1 to 21-5, the first high pressure port 120 may be provided with a variable valve 500 operable to vary the flow area of the first high pressure port 120.

Figure 20:
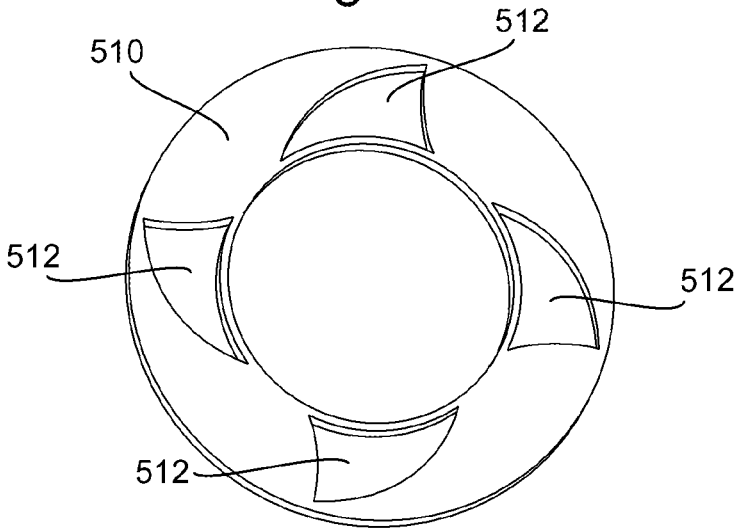

The variable valve 500 may comprise a control disc 510 as shown in FIG. 20. In the example shown the control disc 510 is centred on and rotatable around the hub axis 306. The control disc 510 defines an aperture 512. The control disc may comprise an aperture 510 for each first high pressure port 120 provided. The control disc 510 is operable to moved so that the or each aperture 510 is in alignment with, partially in alignment with, or offset from, its respective the first high pressure port 120 to thereby vary the flow through the respective first high pressure port 120.

The control disc 510 may be driven by an external mechanism via a gear profile on the disc and a gear on a sealed shaft. The disk is housed within the high pressure area of the manifold. It rotates around a fixed hub machined into the end plate.

The variable valve mechanism 500 may be located within the high pressure manifold 400. The control disc 510 may be housed within a slot in the manifold. A gear may be used to drive the control disc 510, with a gear profile machined into or attached to the rotatable disk.

In a further example the shape of the control disc aperture 512 may comprise a curved outer profile, which allows for a gradual closing and opening of the first high pressure port 120 whilst maintaining a sharp cut off for the interface with aperture 242 (i.e. baffle 244). This avoids the first high pressure ports 120 gradually opening and allows more accurate control of the compression ratio.

Figure 14:
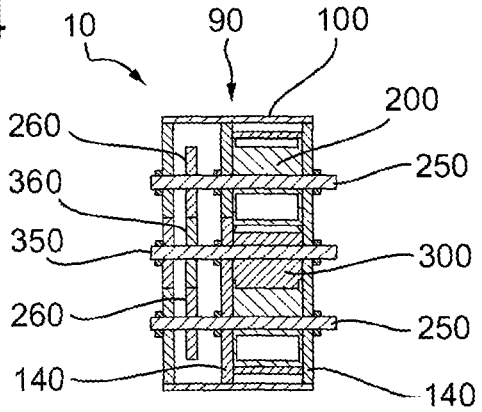
FIG. 14 shows a side sectional view of an example of the rotor unit assembly of the present disclosure shown in FIG. 1, with additional housing illustrated.

As shown in FIGS. 1, 2, 14 the rotor 200 is mounted to the housing 100 via a rotor shaft 250 centred on the chamber central axis 106 and the hub 300 is mounted to the housing 100 via a hub shaft 350 centred on the hub axis 306. The shafts 250, 350 are parallel to one another.

The shafts 250, 350 are rotatably mounted relative to the housing end plates 140, and extend through the housing end plates 140. A rotor gear wheel 260 is coupled to the rotor shaft 250 on the opposite side of an end plate 140 to the rotor 200. A hub gear wheel 360 is coupled to the hub shaft 350 on the opposite side of an end plate 140 to the hub 300. The rotor gear wheel 260 is rotatably engaged with the hub gear wheel 360.

Conventional oil film bearings may be positioned on the outside of the working fluid assembly, with the use of oil sealing arrangements preventing the ingress of oil into the working fluid. This allows for oil free operation within the working fluid space. Alternatively rolling element bearings may be used.

To maintain clearances within the machine each shaft has one axial bearing in additional to radial bearings, which maintains the axial position of the rotors relative to the casing.

In one example, each of the shafts 250, 350 defines a passage 252, 352 (not shown), for the flow of cooling fluid therethrough, where each passage extends along the length of the respective shaft 250, 350, open at both ends outside of the housing 100.

As shown in FIG. 3 there may be provided cooling spaces 600 between the housing outer wall 100 casing and chamber walls 102.

Method of Operation as a Compressor

Figures 1, 18:
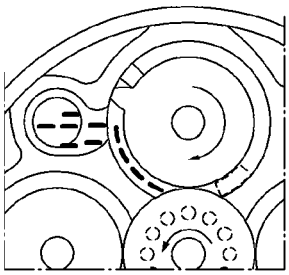
Figures 2, 18:
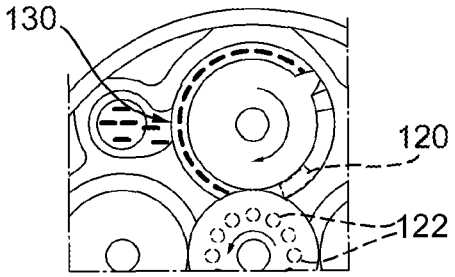
Figures 3, 18:
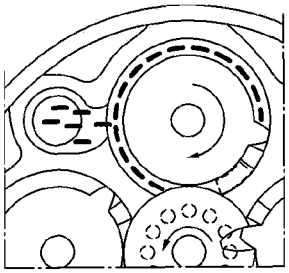
Figures 4, 18:
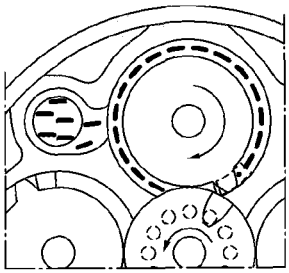
Figures 5, 18:
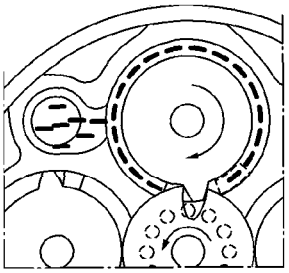
Figures 6, 18:
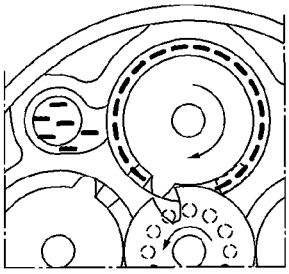
Figures 7, 18:
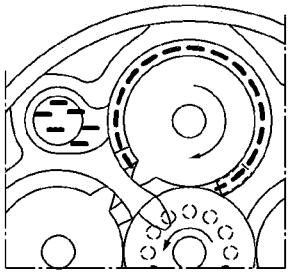
Figures 8, 18:
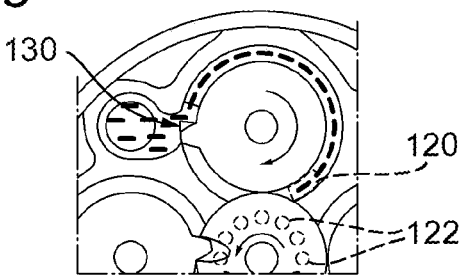
Figures 9, 18:
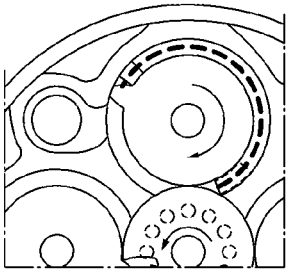
Figures 10, 18:
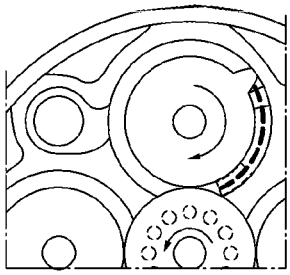
Figures 11, 18:
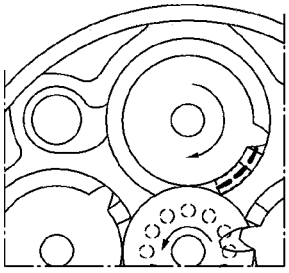
Figures 12, 18:
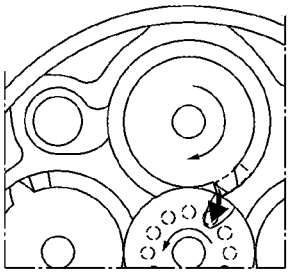
Figures 13, 18:
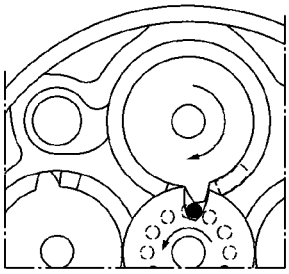
Figures 14, 18:
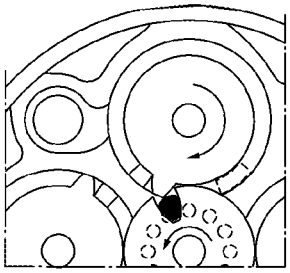
Figures 15, 18:
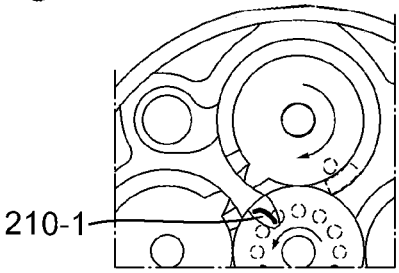
Figures 16, 18:
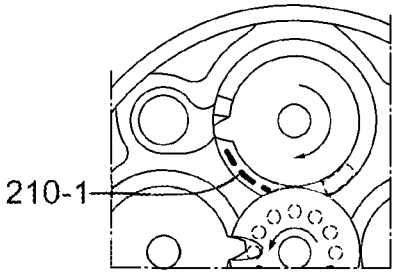

FIGS. 18-1 to 18-16 illustrate how the rotor unit 10 of the present disclosure may operate when configured as a compressor. In this example relating to a compressor, the working fluid enters the clearance volume 210 at a first pressure and is worked on by the piston 214 to leave the clearance volume 210 through the first high pressure valve 120 and second high pressure valve 122 at a second pressure, where the second pressure is substantially greater than the first pressure.

By virtue of their driving engagement, the rotor 200 and hub 300 are rotatable in opposite directions. In the example shown the rotor 200 rotates clockwise and the hub 300 rotates anticlockwise. In other examples the rotor 200 is operable to rotate anticlockwise so the hub 300 rotates clockwise, and in such an example the location of the ports 120, 122, 130 would be flipped also such that the sequence of port opening and closing is maintained.

As shown in FIGS. 18-1 to 18-7, as the rotor 200 rotates clockwise about the chamber central axis 106 to perform an intake stroke, and the hub 300 rotates anti clockwise about the hub axis 306, a working fluid (for example a compressible fluid) passes/flows through the first low pressure port 130 and into the radial space around the outside of the rotor 200 (i.e. into the clearance volume 210) to fill the volume behind the piston 214 as it advances around the clearance volume 210.

The working fluid is delivered from a source, for example from atmosphere, the local environment, or from a reservoir of working fluid. In examples in which a manifold 400 is provided, the working fluid is delivered from the low pressure chamber 410, which may be in fluid communication with the low pressure source.

As shown, the intake stroke starts when the piston 214 passes the first low pressure port 130 to allow working fluid into the volume trailing the piston 214 (i.e. between the position shown in FIG. 17-2 and FIG. 17-3). The intake stroke is a complete rotation of the rotor 200, ending the next time the piston 214 starts to cross the first low pressure port 130 (i.e. FIG. 18-8), thereby isolating the working fluid taken in on the stroke, ahead of the piston 214, from the working fluid entering the clearance volume 210 behind the piston.

During this time the first high pressure port 120 and second high pressure port 122 are closed to the working fluid filling the clearance volume behind the piston 214. That is to say, the first high pressure port 120 and second high pressure port 122 are closed by virtue of being covered by the valve flange 240 and hub 300 respectively. As the piston 214 meshes with the cavity 314 of the hub 300, a seal is formed between the piston 214 and the hub 300 (i.e. between the piston 214 and the walls of the cavity 314 of the hub 300, as shown in FIG. 18-5) and then between the rotor 200 outer surface 208 and the hub outer surface 308. The seal between the rotor 200 outer surface 208 and the hub outer surface 308 is maintained as the piston 214 rotates around the chamber 104 central axis 106 such that the working fluid is compressed between the advancing piston 214 and the point of contact between the rotor 200 and the hub 300, as shown in FIGS. 18-8 to 18-11.

As shown in FIG. 18-11, the first high pressure port 120 is then aligned with the valve flange aperture 242 to open the first high pressure port 120, allowing fluid to be exhausted (i.e. forced out) through the first high pressure port 120.

Figure 12:
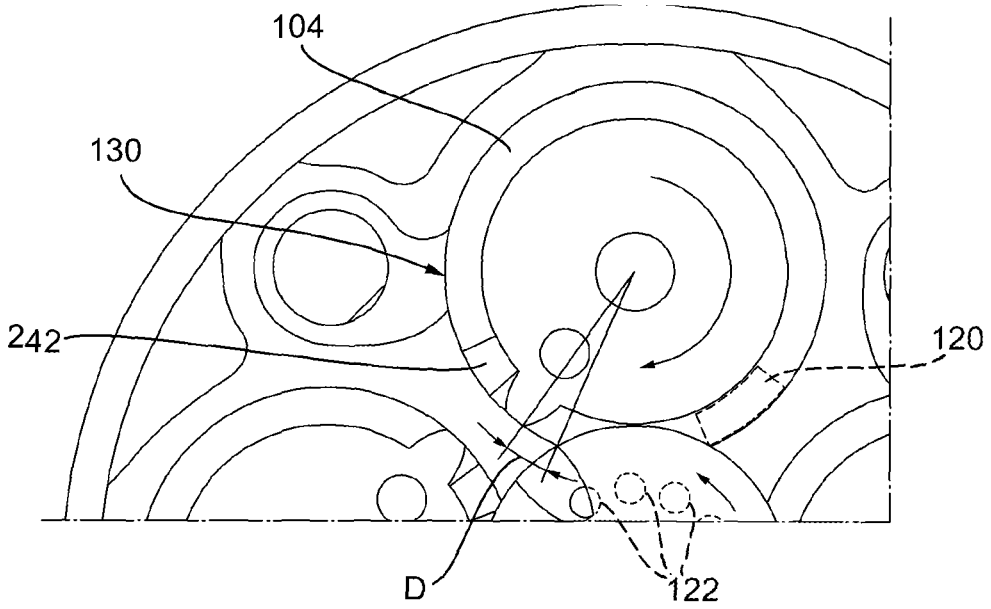

As shown in FIG. 18-12, the first high pressure port 120 is then closed as the valve flange aperture 242 passes the first high pressure port 120. That is to say, the first high pressure port 120 is then closed as the valve flange aperture 242 becomes offset from (i.e. misaligned with) the first high pressure port 120.

Figure 13:
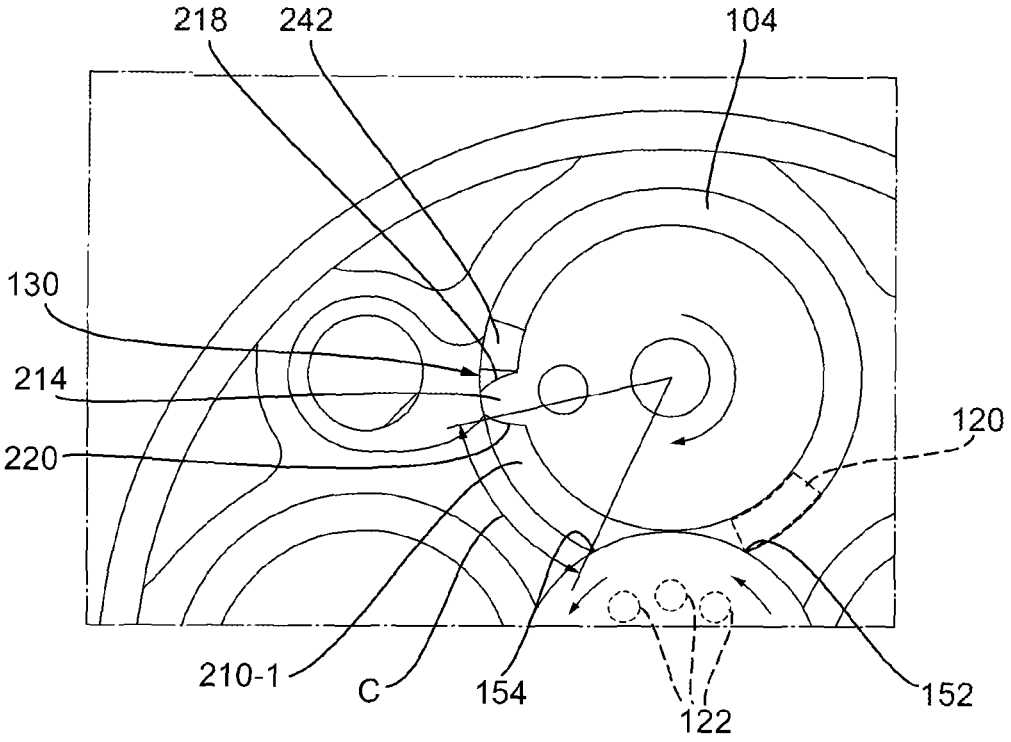

As shown in FIG. 18-13, with the first high pressure port 120 closed, the cavity 314 passes over (i.e. uncovers, becomes aligned with) the second high pressure port 122 and it remains open (FIG. 18-13 to 18-15) so pressurised working fluid may pass either way through the second high pressure port 122 (e.g. from the cavity 314 through the second high pressure port 122 to the high pressure chamber 420 of the manifold 400 (if provided), or in the reverse direction, for example from the high pressure chamber 420 of the manifold 400 (if provided) into the cavity 314. It may be that as the piston 214 and cavity 314 mesh, flow occurs first in one direction through the second high pressure port 122 and then in the opposite direction through the second high pressure port 122. For example as the gap between the walls of the piston 214 and cavity 314 close together (for example in FIG. 18-13), there is a net flow from the cavity 314 through the second high pressure port 122, and as the piston 214 leaves (i.e. disengages from) the cavity 314 (for example in FIG. 18-14) there is net flow through the second high pressure port 122 into the cavity 314. In this way unnecessary work on the working fluid is avoided (i.e. because fluid is displaced but not compressed in the cavity 314 by the action of the piston 214 and cavity meshing together.

As shown in the sequence portrayed by FIGS. 18-15 to 18-16, as the piston 214 leaves the cavity 314, the high pressure port 122 is isolated from the radial space around the rotor 200 in the expansion region 210-1. A small amount of working fluid is trapped in the expansion region 210-1, and expanded as the piston 214 travels around the clearance volume 210. The expansion region 210-1 increases in volume as the piston 214 approaches the low pressure port 130 so as to reduce the working fluid pressure in the expansion region 210-1 to approach, or equal, the value of the low pressure fluid source/reservoir. Hence when the first low pressure port 130 opens, the net flow of working fluid is into the clearance volume 210.

The dimensions of the expansion region 210-1 may thus be chosen in dependence of the intake pressure through the first low pressure port 130 and expected exhaust pressure through the first high pressure port 120. That is to say, dimensions of the expansion region 210-1 may thus be chosen in dependence of the desired compression ratio of the rotor unit 90.

Figures 1, 21:
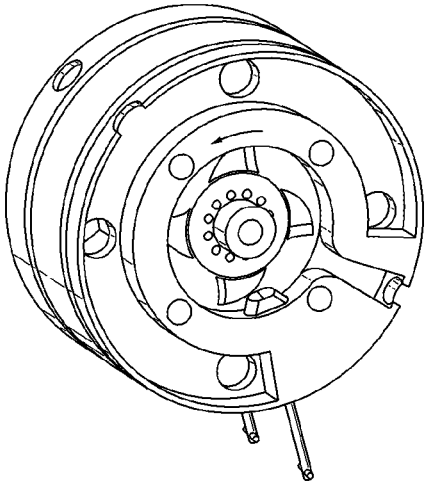
Figures 2, 21:
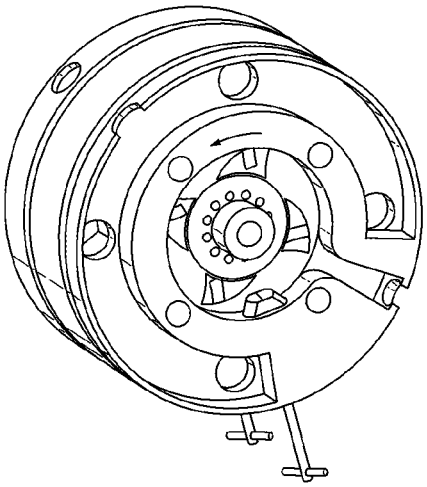
Figures 3, 21:
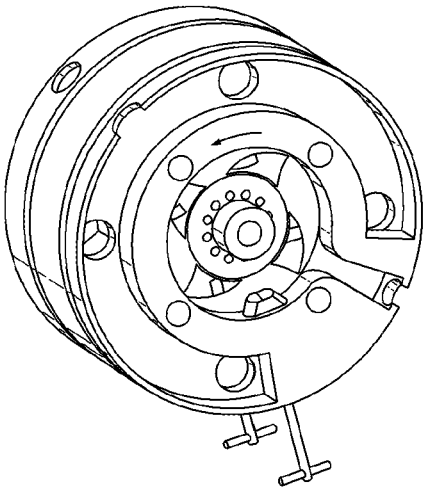
Figures 4, 21:
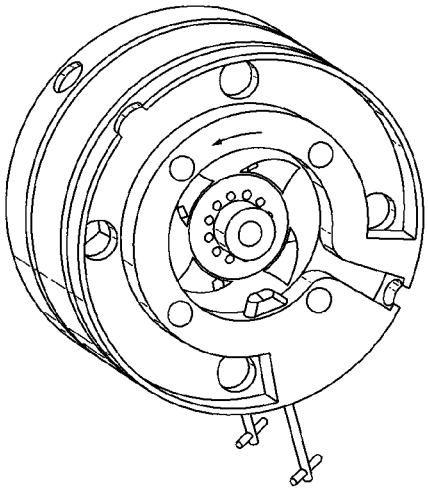
Figures 5, 21:
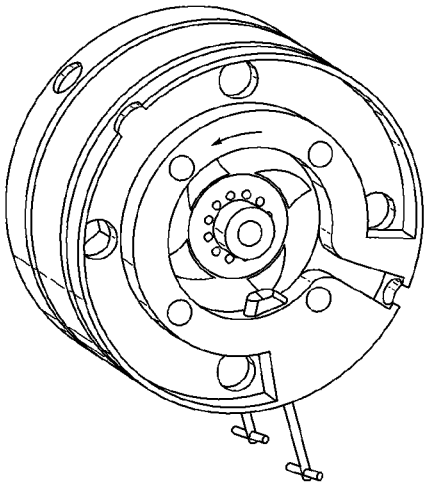

During (and/or before) operation of the rotor unit 90, the control disc 510 may be controlled to rotate to thereby set the effective flow area of the first high pressure ports 120 as desired (and as illustrated in FIGS. 21-1 to 21-5) and thereby set the compression ratio of the rotor unit.

Hence there is provided a rotor unit assembly with increased efficiency and flexibility of performance compare to examples of the related art.

Primary efficiency is achieved by the positioning of the low pressure port 130 circumferentially away from the hub 300. This allows for any working fluid (for example, fluid compressed by the piston 214 as it travels around the clearance volume 210) which is not exhausted through the valve flange aperture 242 and first high pressure port 120 and/or hub cavity 314 and second high pressure port 122 to be expanded in the expansion region 210-1 (and therefore reduced in pressure) before being mixed with fluid entering from the first low pressure port 130. The expanded working fluid from the expansion region 210-1 is thus re-circulated through the clearance volume 210. Hence the pressure of the re-circulated working fluid from the expansion region 210-1 and the fluid entering the first low pressure port 130 is balanced. This avoids losses associated with passing high pressure fluid (e.g. from the high pressure chamber 420) to an area where there is a flow path to a low pressure fluid port or connection. This arrangement also has the advantage that work is done on the piston as expansion occurs in the expansion region 210-1, increasing the efficiency of the device as less external input is required to operate the rotor unit assembly.

The provision of the second high pressure ports 122 in the path of the cavity 314 of the rotor 300 also provides an exhaust path for working fluid trapped in the cavity 314 as the piston 214 and cavity 314 mesh. This prevents over compression of fluid in the cavity 314, reducing the amount of energy input needed to turn the rotor, and therefore increasing the efficiency of the unit.

In examples in which it is present, the variable valve 500, and its control mechanism, provide flexible and adjustable performance, to allow the compression ratio of the rotor assembly unit to be changed. The control disc 510, and hence the apertures it defines, may be rotated in either direction to adjust (i.e. increase and reduce) flow through the first high pressure port 120, and thereby adjust the compression ratio of the rotor unit assembly in a controlled manner, on demand and/or as required, and independently of other operating parameters, for example rotor speed. The variable valve 500 may be operable while the rotor unit assembly is being operated and/or when the rotor unit is not operating (i.e. rotor 200 and hub 300 are not rotating). Either way, the machine 10 compression ratio can be matched to the demand of the system it is operating in.

Additionally, because first low pressure port 130 is located around the circumference of the chamber 104, spaced apart from the high pressure ports 120, 122, the low pressure port 130 may be located in a region of the housing 100 which allows it to have a larger outlet/flow path to the clearance volume 210, and thus define a flow path with a large cross-sectional flow area where it intersects the clearance volume 210, and thus a large flow volume, which thereby reduces fluid flow losses in fluid being delivered to the working chamber ahead of the piston 214.

The device may operate without the need of a fluid lubricant (e.g. using low friction coatings instead of oil) thereby enabling the rotor unit to be provided as a sealed low maintenance unit, and broadening the range of industries it may be used in (for example air pumps for breathing apparatus and/or food manufacture).

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A rotor unit assembly comprising:

a wall section of a housing which defines a chamber having a central axis and an inner surface, and the housing comprises an end plate to close the chamber;

a rotor located within the chamber and rotatable about the chamber central axis of the chamber the, rotor having: a main body having an outer surface, the outer surface being spaced apart from the wall section inner surface to define a clearance volume; a piston which extends radially outward from the main body of the rotor; and a valve flange which extends radially from the outer surface of the main body, and is rotatable about the central axis of the chamber, with an aperture provided in the valve flange; and a rotatable hub rotatable about a hub axis, with a cavity which extends radially inward from a hub outer surface, wherein the cavity is configured to receive the piston;

wherein the end plate of the housing defines:

a low pressure port provided in a path described by the piston around the clearance volume;

a first high pressure port positioned in a path described by the valve flange aperture around the clearance volume such that the first high pressure port is open when the aperture is aligned with the first high pressure port, and closed when the aperture is misaligned with the first high pressure port; and a second high pressure port positioned in a path described by the cavity around the hub axis such that the second high pressure port is open when the cavity is aligned with the second high pressure port, and closed when the cavity is misaligned/offset with the second high pressure port.

2. The rotor unit assembly of claim 1, wherein the wall section defines an opening having a first edge spaced apart from a second edge through which the hub extends to seal against the rotor, a seal being provided between the hub outer surface and the first edge of the opening.

3. The rotor unit assembly of claim 2, wherein the first high pressure port, the first edge of the wall section opening, the second high pressure port, the second edge of the wall section opening, and the low pressure port are arranged in series in a direction of rotation of the piston around the clearance volume.

4. The rotor unit assembly of claim 1, wherein when the first high pressure port is open, the piston forms a seal with the inner surface of the chamber.

5. The rotor unit assembly of claim 1, wherein when the second high pressure port is open, the piston is engaged with the cavity to provide a seal between the piston and the wall of the cavity.

6. The rotor unit assembly of claim 5, wherein the wall section defines an opening having a first edge spaced apart from a second edge through which the hub extends to seal against the rotor, a seal being provided between the hub outer surface and the second edge of the opening, and wherein the cavity is configured to be isolated from the clearance volume when the piston has moved (D) degrees around the inner surface of the chamber away from the second edge of the opening through which the hub extends, to define an expansion region of the clearance volume between the piston and the hub, the expansion region thereby isolated from a remainder of the clearance volume, where (D) has a value of at least 8 but not more than 16 degrees.

7. The rotor unit assembly of claim 6, wherein an opening of the low pressure port is positioned (C) degrees around the inner surface of the chamber away from the second edge of the opening through which the hub extends, where (C) has a value of at least (D×compression ratio×80%), but no more than (D×compression ratio×120%).

8. The rotor unit assembly of claim 1, wherein the rotor and hub are operable to rotate in opposite directions around their respective axes, and configured such that as they rotate the first high pressure port is closed before the second high pressure port is opened.

9. The rotor unit assembly of claim 1, operable such that: when the first high pressure port is open, the second high pressure port is closed and the low pressure port is fluidly isolated from the first high pressure port; and when the second high pressure port is open, the first high pressure port is closed and the low pressure port is isolated from the second high pressure port by a seal between the piston and the hub.

10. The rotor unit assembly of claim 1, wherein the first high pressure port, the second high pressure port, and the low pressure port extend through the end plate at one side of the chamber to each provide a fluid conduit therethrough.

11. The rotor unit assembly of claim 10, wherein the first high pressure port and second high pressure port are each exhaust conduits from the clearance volume, and the low pressure port is an inlet conduit to the clearance volume.

12. The rotor unit assembly of claim 10 wherein:

the first high pressure port, the second high pressure port, and the low pressure port are in fluid communication with a manifold;

the low pressure port being in fluid communication with a low pressure chamber of the manifold; and the first high pressure port and second high pressure port being in fluid communication with a high pressure chamber of the manifold; and the low pressure chamber and high pressure chamber being separated from one another by a wall such that the low pressure chamber and the high pressure chamber are fluidly isolated from one another.

13. The rotor unit assembly of claim 12, wherein the first high pressure port is provided with a variable valve operable to vary the flow area of the first high pressure port.

14. The rotor unit assembly of claim 13, wherein the variable valve comprises:

a control disc centred on and rotatable around the hub axis;

the control disc defining an aperture; and the control disc operable to be moved so that the aperture is in alignment with, partially in alignment with, or offset from, the first high pressure port to thereby vary the flow therethrough.

15. The rotor unit assembly of claim 1, wherein the rotor is mounted to the housing via a rotor shaft centred on the chamber central axis, and the hub is mounted to the housing via a hub shaft centred on the hub axis, wherein the rotor and hub shafts are parallel to one another.

16. The rotor unit assembly of claim 1, comprising a plurality of rotors, each rotor spaced apart from one another around the hub axis, the rotors each being mounted relative the hub such that, for each rotor:

the hub outer surface is in sealing contact with the outer surface of the respective main body as the respective piston travels around the respective clearance volume; and the cavity and the respective piston are positioned to engage during part of the rotation of the respective rotor and hub around their respective axes.

17. A rotor unit assembly, comprising:

a wall section of a housing which defines a chamber having a central axis and an inner surface, and the housing comprises an end plate to close the chamber, wherein the endplate defines a low pressure port, a first high pressure port, and a second high pressure port;

a rotor located within the chamber and rotatable about the chamber central axis, the rotor having a main body having an outer surface, the outer surface being spaced apart from the wall section inner surface to define a clearance volume, a piston which extends radially outward from the main body, and a valve flange which extends radially from the outer surface of the main body and is rotatable about the central axis of the chamber, with an aperture provided in the valve flange; and a rotatable hub rotatable about a hub axis, with a cavity which extends radially inward from a hub outer surface, wherein the cavity is configured to receive the piston;

wherein when the first high pressure port is open, the piston forms a seal with the inner surface of the chamber, when the second high pressure port is open, the piston is engaged with the cavity to provide a seal between the piston and the wall of the cavity, the wall section defines an opening having a first edge spaced apart from a second edge through which the hub extends to seal against the rotor, a seal being provided between the hub outer surface and the second edge of the opening, and the cavity is configured to be isolated from the clearance volume when the piston has moved (D) degrees around the inner surface of the chamber away from the second edge of the opening through which the hub extends, to define an expansion region of the clearance volume between the piston and the hub, the expansion region thereby isolated from a remainder of the clearance volume, where (D) has a value of at least 8 but not more than 16 degrees.

18. The rotor unit assembly of claim 17, wherein an opening of the low pressure port is positioned (C) degrees around the inner surface of the chamber away from the second edge of the opening through which the hub extends, where (C) has a value of at least (D×compression ratio×80%), but no more than (D×compression ratio×120%).

19. A rotor unit assembly, comprising:

a wall section of a housing which defines a chamber having a central axis and an inner surface, and the housing comprises an end plate to close the chamber, wherein the endplate defines a low pressure port, a first high pressure port, and a second high pressure port;

a rotor located within the chamber and rotatable about the chamber central axis, the rotor having a main body having an outer surface, the outer surface being spaced apart from the wall section inner surface to define a clearance volume, a piston which extends radially outward from the main body, and a valve flange which extends radially from the outer surface of the main body and is rotatable about the central axis of the chamber, with an aperture provided in the valve flange; and a rotatable hub rotatable about a hub axis, with a cavity which extends radially inward from a hub outer surface, wherein the cavity is configured to receive the piston;

wherein the first high pressure port, the second high pressure port, and the low pressure port are in fluid communication with a manifold;

wherein the low pressure port is in fluid communication with a low pressure chamber of the manifold;

wherein the first high pressure port and second high pressure port are in fluid communication with a high pressure chamber of the manifold; and wherein the low pressure chamber and high pressure chamber are separated from one another such that the low pressure chamber and the high pressure chamber are fluidly isolated from one another.

20. The rotor unit assembly of claim 19, wherein the first high pressure port is provided with a variable valve operable to vary the flow area of the first high pressure port.

* * * * *